US005159294A

United States Patent [19]

Ishikawa et al.

[11] Patent Number: 5,159,294

[45] Date of Patent: Oct. 27, 1992

[54] NON-RECIPROCAL CIRCUIT ELEMENT

[75] Inventors: Youhei Ishikawa; Takekazu Okada; Keiji Okamura; Takashi Kawanami, all of Nagaokakyo, Japan

[73] Assignee: Murata Manufacturing Co., Ltd., Japan

[21] Appl. No.: 662,426

[22] Filed: Feb. 28, 1991

[30] Foreign Application Priority Data

Mar. 1, 1990 [JP] Japan ..... 2-50675
Mar. 12, 1990 [JP] Japan ..... 2-61976

[51] Int. Cl.[5] ..... H01P 1/383

[52] U.S. Cl. ..... 333/1.1; 174/52.1; 333/24.2

[58] Field of Search ..... 333/1.1, 24.2, 239; 174/35 MS

[56] References Cited

U.S. PATENT DOCUMENTS 3,195,079 7/1965 Burton et al. ..... 333/239
3,522,555 8/1970 Hashimoto et al. ..... 333/1.1
4,831,210 5/1989 Larson et al. ..... 174/35 MS
5,017,894 5/1991 Naito ..... 333/1.1

FOREIGN PATENT DOCUMENTS 1-17501 5/1989 Japan ..... 333/1.1

*Primary Examiner*—Paul Gensler
*Attorney, Agent, or Firm*—Ostrolenk, Faber, Gerb & Soffen

[57] ABSTRACT

A non-reciprocal circuit element which includes a case, a circuit element main body provided in the case including central conductors disposed to intersect each other in an electrically insulated state and matching circuitry, and ferrite members disposed to confront the central conductors so as to impress a d.c. magnetic field. The case is made of an insulative resin, and covered by electrode films formed to constitute at least part of the circuit element main body and terminals for the central conductors.

12 Claims, 7 Drawing Sheets

NON-RECIPROCAL CIRCUIT ELEMENT

BACKGROUND OF THE INVENTION

The present invention generally relates to a circuit element, and more particularly, to a non-reciprocal circuit element such as a circulator or isolator to be employed as a high frequency part for a microwave band region, which is especially so arranged to decrease cost through reduction of the number of parts and man-hours required for assembly, with simultaneous achievement of compact size and light weight.

Generally, a circulator or isolator has such a function that it has almost no attenuation in the direction of transmission of a signal, with an increasing attenuation of the signal in a direction opposite thereto, and is employed, for example, in a transmission circuit of a mobile communication apparatus such as a portable telephone, automobile telephone or the like.

For such an isolator, there has conventionally been available an arrangement as shown in FIG. 15.

In FIG. 15, the known isolator 40 generally includes a magnetic material metallic case 41, a ferrite assembly 44 constituted by a pair of ferrite members 43 confronting a plurality of central conductors 42, and disposed within the metallic case 41, with said ferrite assembly 44 being located in central holes 45*a* of a pair of dielectric substrates 45 which have, on the inner surface thereof, a capacitor electrode for a matching circuit, and a pair of permanent magnets 47 held in contact with ground electrodes formed on the outer surface of each of said dielectric substrates 45 respectively through shield plates 46. More specifically, the above ferrite assembly 44 is composed of three sets of network central conductors 42 made for example, of copper plates, and piled up one upon another in an electrically insulated state separated by insulative sheets, crossing or intersecting each other at 120° angles so as to be held between the two ferrite members 43. To external lead-out portion 42*a* at each end of each of the central conductors 42, there are connected one end of each of input and output terminal strips 48 embedded in a rectangular frame-like block 49 of a resin material disposed along an inner peripheral edge of the case 41, while the other end of said terminal strips 48 project outwardly from an opening 41*a* formed in said case 41.

When an isolator or circulator is to be employed, e.g. in a portable telephone, a reduction in the cost of its parts is required from the viewpoint of its end use, with a simultaneous demand for compact size and light weight.

However, the conventional isolator as referred to above has such a disadvantage that it can not fully meet the requirement of cost reduction due to its construction, and there are limitations on the compact size and weight reduction that are available.

More specifically, assembling of the conventional ferrite assembly involves a complicated process in which the insulative sheets are inserted between the respective central conductors, while said central conductors are alternately crossed over each other, and moreover, such assembly must be inserted into the case through proper positioning. Accordingly, the number of parts and man-hours required for assembling are undesirably increased, with an increase of cost to that extent.

Additionally, due to the employment of the metallic case, it is necessary to make the case rather larger so as to provide a space between the case and circuit elements for avoiding short-circuits resulting from contact of the case with the respective circuit elements, thus also resulting in a larger size, while the weight reduction is obstructed due to employment of the metallic material for the case.

SUMMARY OF THE INVENTION

Accordingly, an essential object of the present invention is to provide a non-reciprocal circuit element which is capable of realizing compact size and light weight as a part, with simultaneous lowering of cost through reduction in the number of parts and man-hours required for assembling.

Another object of the present invention is to provide a non-reciprocal circuit element of the above described type, which is simple in construction and stable in functioning, and can be readily manufactured at low cost.

In accomplishing these and other objects, according to one preferred embodiment of the present invention, there is provided a non-reciprocal circuit element which includes a case, a circuit element main body in said case including central conductors disposed to intersect each other in an electrically insulated state and including matching circuitry, and ferrite members disposed to confront said central conductors so as to impress thereto a d.c. magnetic field. The case is made of an insulative resin, and is covered by an electrode film means formed to constitute at least part of said circuit element main body.

In another aspect of the present invention, the case of said non-reciprocal circuit element further includes a substrate portion integrally formed therewith. The substrate portion is covered, on its one main surface, with part of the central conductors, and on its other main surface, with the remaining portion of said central conductors, while the respective central conductors are connected to each other by a through-hole electrode means extending through the substrate portion.

In connection with the above, for forming the central conductors on the substrate portion, a photo-etching process in which electrode films are formed on opposite main surfaces of said substrate portions, with subsequent elimination of unnecessary portions of said electrode films, or the electroless plating process, may be employed. In the case where, for example, electroless plating is employed, a resin material to which the plating adheres and another resin material to which the plating does not adhere are employed. First, portions to be formed with the electrode films of the substrate portion are injection-molded, by said resin material to which the plating can adhere, and then, the resultant molded item is disposed within a metal mold having a shape corresponding to the final substrate portion, and injection molding is effected by pouring the resin material to which the plating does not adhere, into said metal mold, whereby the case is formed through such injection molding in two stages. Thereafter, by applying electroless plating to the case, the electrode films may be formed, e.g. only as the central conductor portions referred to above.

In, in the non-reciprocal circuit element according to the present invention, since the case is formed of the insulative resin, and for example, the substrate portion is integrally formed within said case, with the electrode film for constituting the circuit element main body being formed on said substrate portion, patterns for the circuit element main body such as the central conductors, etc. may be readily formed by electroless plating, photo-etching or the like. Thus, complicated assembling work conventionally required, in which the respective central conductors must be piled one upon anther, separated by insulative sheets, for insertion into the case while being properly positioned, can be dispensed with. Moreover, owing to the integral formation of the substrate portion with the case, the number of parts may be reduced as compared with the conventional ferrite assembly for improvement of productivity and consequent cost reduction, thus meeting the requirement of low cost.

Furthermore, since the case of the present invention is of electrically insulative nature, without possibility of short-circuiting even upon contact with the respective circuit elements, the spaces or gaps conventionally required for prevention of such short-circuiting may be eliminated for reduction of size to that extent. Additionally, the case made of the resin material according to the present invention may be reduced in weight as compared with the conventional metallic case, and therefore, the overall weight of the circuit element can also be reduced to that extent.

In a further aspect of the present invention, the non-reciprocal circuit element includes a case, a plurality of central conductors disposed to intersect each other in an electrically insulated state and provided in said case, and ferrite members disposed to confront the intersecting portions of the central conductors, with said respective central conductors being arranged to be led out of said case. The case is made of an insulative resin and covered by an electrode film means formed to lead said respective central conductors out of said case.

In the above construction, for forming the electrode film means for external leading-out on said case, processes such as electroless plating, photo-etching, and sputtering, etc. may be adopted.

In the case where, for example, electroless plating is employed for the formation of the electrodes, the resin material to which the plating adheres and another resin material to which the plating does not adhere are similarly employed, and first, the portion of the case corresponding to the portions to be formed with the electrode films are injection-molded with said resin material to which the plating can adhere, and the resultant molded item is disposed within a metal mold having a shape corresponding to the remaining case portion, and then injection molding is carried out by pouring the resin material to which the plating does not adhere, into said metal mold, thereby manufacturing the case by such injection molding in two stages. Thereafter, by applying electroless plating to the case, the electrode films may be formed, e.g. only at the necessary portions.

In the non-reciprocal circuit element according to the present invention, since the case is formed from insulative resin and the electrode films for external connections are formed on said case, the conventional terminal block may be made unnecessary, thus, making it possible to reduce the space required for disposition of the various parts within the case, thereby to achieve size reduction to that extent. Moreover, the number of parts may also be reduced by the elimination of such terminal block, while owing to the omission of assembly work for incorporating the terminal block into the case, another cost reduction may be achieved that extent for further cost reduction Furthermore, owing to the fact that the case made of the electrically insulative resin is free from the possibility of short-circuiting even upon contact with the respective circuit elements, the spaces or gaps conventionally required for prevention of such short-circuiting may be eliminated for reduction of size to that extent. Additionally, the case made of the resin material according to the present invention may be reduced in weight as compared with the conventional metallic case, and therefore, the overall weight of the circuit element can also be reduced to that extent as in the first embodiment.

BRIEF DESCRIPTION OF THE DRAWINGS

These and other objects and features of the present invention will become apparent from the following description taken of several embodiments thereof with reference to the accompanying drawings, in which;

FIG. 1 is an exploded perspective view showing the general construction of an isolator according to a first embodiment of the present invention, FIG. 2 is a top plan view of a case employed in the arrangement of FIG. 1, FIG. 3 is a bottom plan view of the case shown in FIG. 2, FIG. 4 is a top plan view of the isolator as assembled shown in FIG. 1, FIG. 5 is a cross section taken along the line V—V in FIG. 4, FIG. 6 is also a cross section taken along the line VI—VI in FIG. 4, FIGS. 7 to 14 relate to a non-reciprocal circuit element in the form of a circulator according to another embodiment of the present invention.

DETAILED DESCRIPTION OF THE INVENTION

Figure 1:
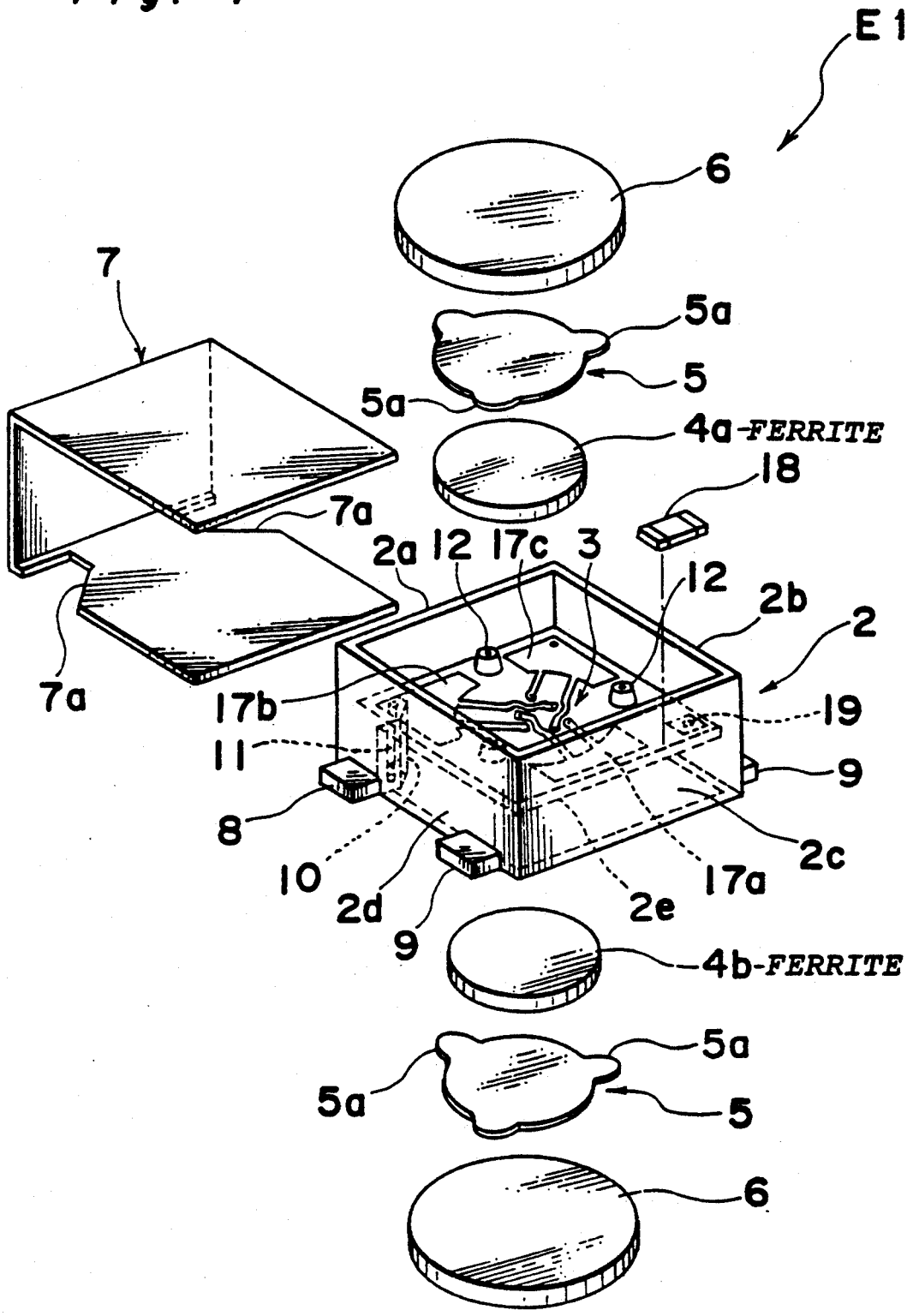
FIGS. 1 to 6 relate to a non-reciprocal circuit element in the form of an isolator according to one preferred embodiment of the present invention.
Figure 2:
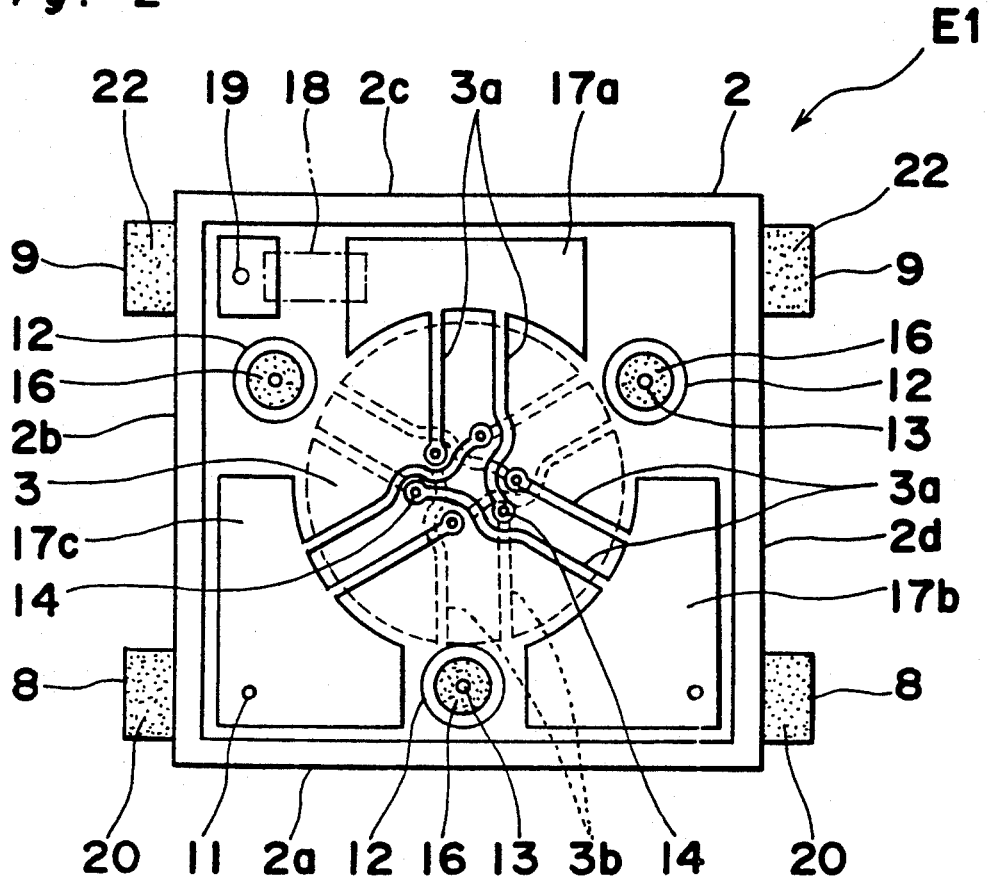

Before the description of the present invention proceeds, it is to be noted that like parts are designated by like reference numerals throughout the accompanying drawings.

Referring now to the drawings, there is shown in FIGS. 1 to 6, a non-reciprocal circuit element E1 according to one preferred embodiment of the present invention as applied to a concentrated constant type or lumped-parameter type isolator.

In FIG. 1, the lumped-parameter type isolator E1 includes a box-like case 2, a pair of ferrite members 4a and 4b disposed in the case to confront central conductors 3 provided in said case, a pair of grounding plates 5 made of copper and disposed on outer surfaces of the respective ferrite members 4a and 4b, and a set of permanent magnets 6 further provided on outer faces of said grounding plates 5, thereby to apply a d.c. magnetic field to said central conductors 3 by said permanent magnets 6.

Onto the case 2, a metallic yoke 7 of a magnetic material having a U-shaped cross section is applied for closing upper and lower openings of the case 2 so as to form a magnetic closed circuit thereby. The metallic yoke 7 is further formed with notches 7a by cutting opposed edges in its lower wall for preventing short-circuiting with respect to terminal portions to be described later.

Figure 3:
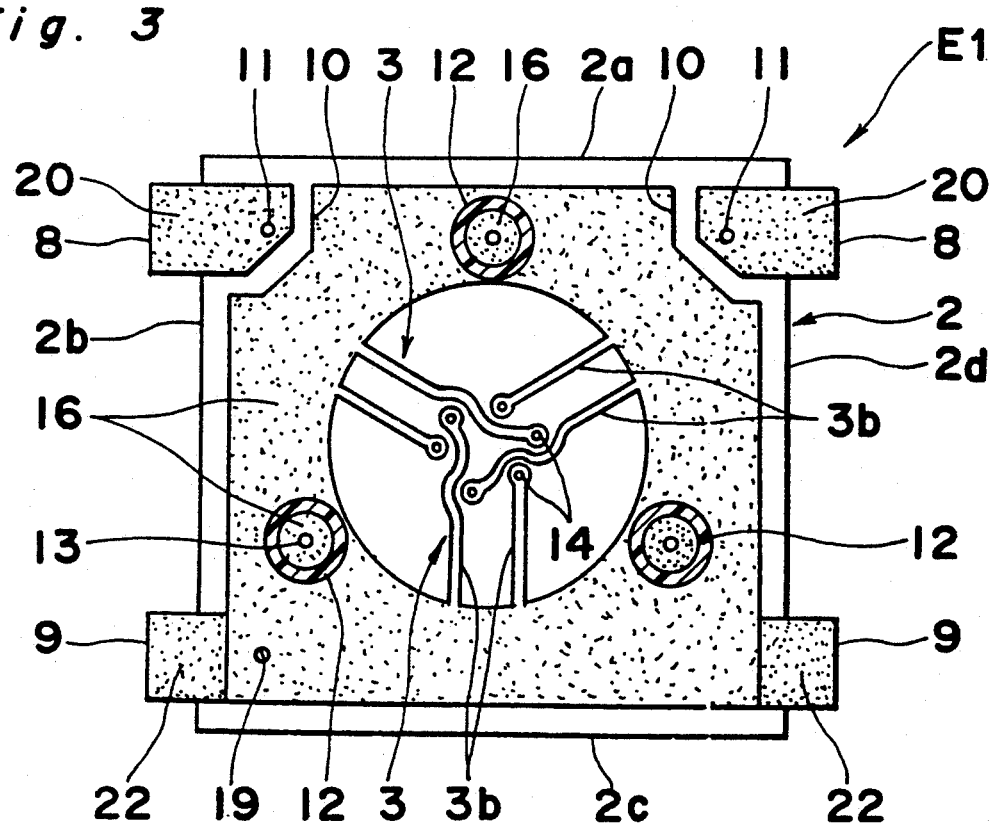
Figure 4:
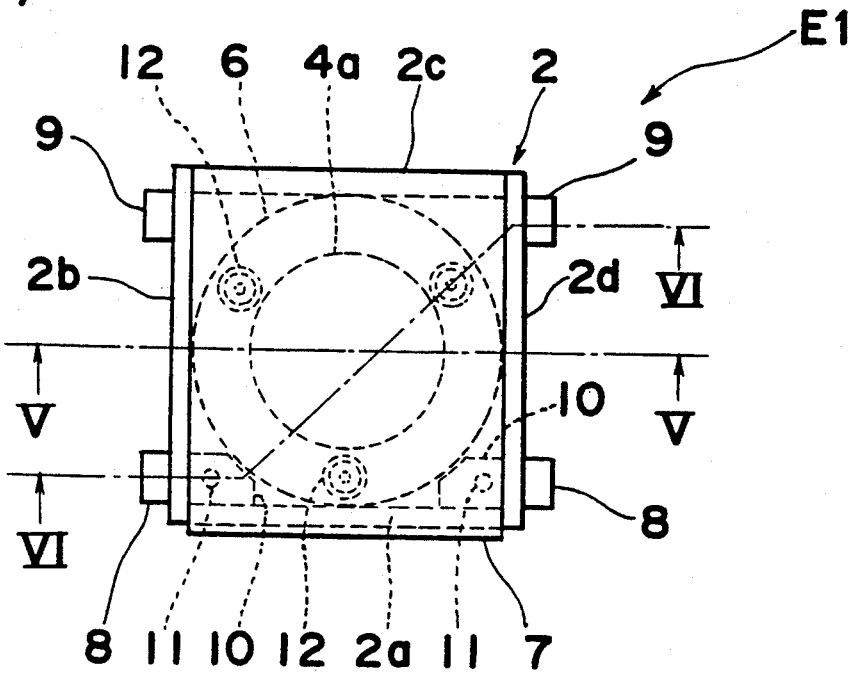
Figure 5:
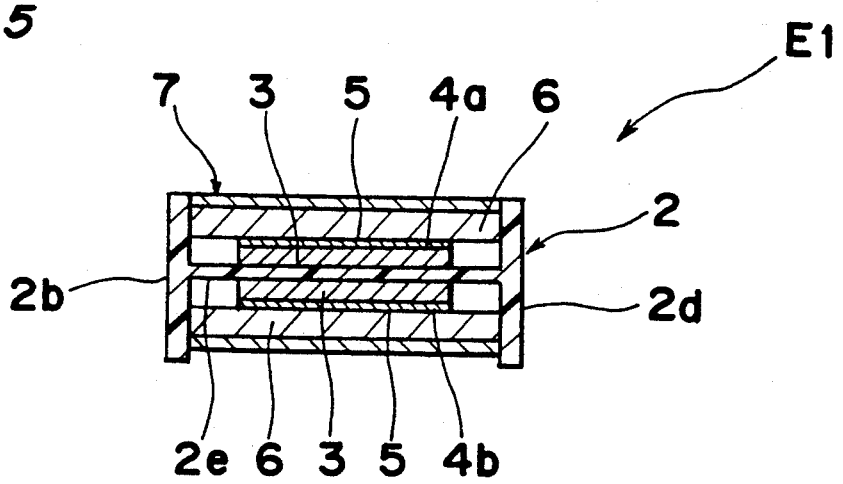
Figure 6:
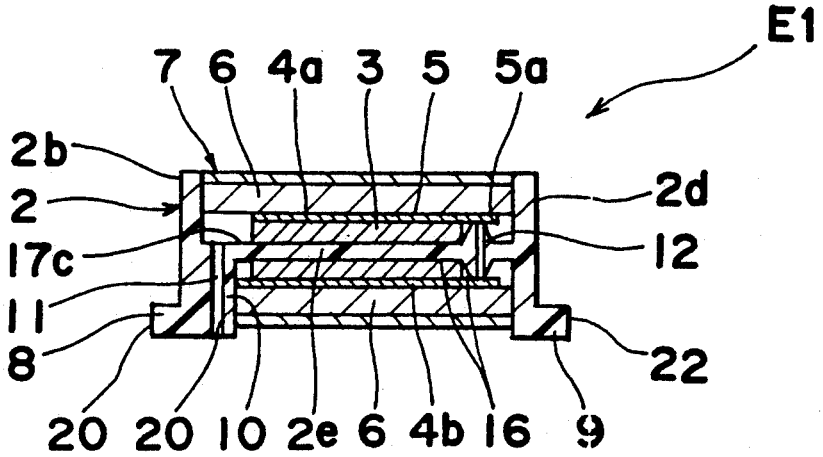
Figure 7:
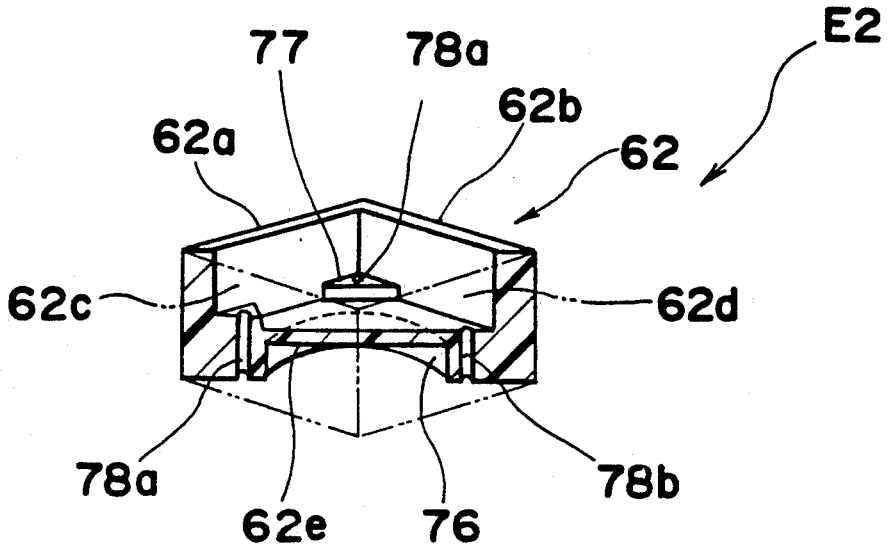
FIG. 7 is a perspective view, partly in section, showing a case for a circulator according to a second embodiment of the present invention.

The case 2 referred to above made of an insulative resin material has first to fourth side walls 2a,2b,2c and 2d, and is formed into a rectangular cubic box-like configuration. At the central portion in the case 2, there is integrally formed a substrate portion 2e, by which the interior of the case 2 is divided into an upper portion and a lower portion. Moreover, at lower opposite end portions on the external face of each of the second and fourth walls 2b and 2d of said case 2, a terminal portion 8 and a grounding portion 9 are integrally formed with said wall. Furthermore, at a corner portion of the second and fourth side walls 2b and 2d adjacent to said first side wall 2a at the lower portion of the substrate portion 2e, an angular portion 10 extending towards the under face of the case 2 is formed by expanding, i.e., extending, the side walls inward as seen in FIG. 3, with a through-hole 11 extending in a vertical direction being formed through said angular portion 10. The upper end of said through-hole 11 extends through onto the upper face of said substrate portion 2e, while the lower end thereof also extends through onto the lower face of the terminal portion 8.

At three portions on each of the upper and lower faces of said substrate portion 2e, conical projections 12 to contact the peripheral surface of each of the ferrite members 4a and 4b for positioning thereof are formed at an interval of 120°, with a height of each projection 12 being set to be generally equal to a thickness of each of said ferrite members 4a and 4b. Ground pieces 5a formed to project from the outer peripheral portion of the grounding plate 5 are adapted to be held in contact with the upper faces of the projections 12. Moreover, a through-hole 13 -is formed along an axis of each of said projections 12.

On the upper and lower surfaces of the above substrate portion 2e, first and second portions of the central conductors 3, which are divided into the two portions, are respectively formed. More specifically, the central conductors 3 include a first three sets of parallelly extending conductor pieces 3a (part of the central conductors) formed on the upper surface of said substrate portion 2e, and another second three sets of parallelly extending conductor pieces 3b (remainder of the central conductors) formed on the lower surface of said substrate portion 2e. Each of the conductor piece sets 3a, 3b has radial symmetry about the center point of the substrate portion 2e. Inner ends of the respective conductors 3a and 3b near the center of the substrate portion 2e are adapted to confront each other, with said substrate portion 2e therebetween, so that the respective inner ends are connected to each other via through-hole electrodes 14 formed to extend through said substrate portion 2e. In the above structure, the respective central conductors 3 are arranged to cross or intersect other at 120° angles in an electrically insulated state, and the ferrite members 4a and 4b confront the intersecting portions on the opposite surfaces of the substrate portion 2e.

On the lower surface of the substrate portion 2e except for where the lower ferrite member 4b contacts, and also at the outer faces of the respective projections 12, there are formed grounding electrode films 16, to which outer end portions of the respective conductor pieces 3b on the lower surface of the substrate portion 2e are connected. Moreover, the grounding electrodes 16 extend onto the upper surface of the projections 12 at the upper surface side of the substrate portion 2e via the through-holes 13 of said projections 12, whereby the grounding electrodes 16 are connected to the upper grounding plate 5. Furthermore, on the upper surface of the substrate portion 2e, three capacitor electrode films 17a,17b and 17c for forming a matching circuit are formed, to which electrode films 17a,17b and 17c, the outer ends of the respective conductor pieces 3a on the upper surface are connected. Furthermore, to one of the capacitor electrode film 17a, a chip (i.e., leadless) resistor 18 is connected, and this resistor 18 is connected to the above ground electrode film 16 through a through-hole electrode 19.

Additionally, on the outer faces of the respective terminal portions and the inner peripheral faces of the through-holes 11, input and output electrode films 20 are formed, and said electrode films 20 are connected to two capacitor electrode films 17b and 17c. Moreover, on the outer faces of the respective grounding portions 9, there are formed grounding electrodes 22, which are connected to the grounding electrode films 16 on the lower surface of the substrate portion 2e through inner faces of the second and fourth side walls 2b and 2d of said case 2.

It is to be noted here that the central conductors 3, capacitor electrode films 17a to 17c, input and output electrode films 20 and grounding electrode films 16 and 22 are formed by selectively applying electroless plating to the corresponding portions. For effecting such a selective plating, for example, a practice as follows may be employed.

Specifically, the portions of the case 2 corresponding to the respective electrode films for the grounding portions 9, and through-holes 11 and 13, of the case 2, are first molded by injection molding employing a resin material to which the plating can adhere. Subsequently, the resultant molded item is placed in a metal mold corresponding to the entire configuration of the case 2, and another resin material to which the plating can not adhere is poured into the metal mold. By such injection molding in two stages, the case 2 is formed. Thereafter, by applying the electroless plating to said case 2, the respective electrode films are formed at the required portions described earlier.

Now the functioning and effects of the isolator E1 according to the present invention as described so far will be explained.

It is to be noted here that the isolator E1 of the foregoing embodiment has a function to prevent backflow of a signal, and is indispensable for a mobile communication equipment such as a portable telephone, automobile telephone or the like.

According to the isolator E1 of the present embodiment, since the case 2 is molded from electrically insulative resin, and the substrate portion 2*e* is integrally formed within said case 2*e*, and the electrode films for constituting the circuit element main body such as the central conductors 3, and the capacitor electrodes 17*a* to 17*c* for the matching circuit, etc. are formed on said substrate portion 2*e*, it becomes possible to eliminate the conventionally required assembling work in which the respective central conductors are piled one upon another through interposition of insulative sheets for insertion into the case while being properly positioned. Moreover, according to the present invention, owing to the arrangement that the terminal portions 8 and the grounding portions 9 are integrally formed on the above case 2 so as to be connected to the required internal portions by the electrode films, the conventional terminal block may be dispensed with. Consequently, as compared with the known arrangements employing the ferrite assembly and terminal block, etc., the number of parts and man-hours required for the assembling may be decreased for reduction of cost.

Furthermore, since the case 2 is made of insulative resin, short-circuiting does not take place even upon contact thereof with the respective circuit elements such as the grounding plates 5, etc., and since the known terminal block is not required, the required space for disposing such terminal block and for preventing short-circuiting may be omitted for smaller size of the part to that extent. Additionally, since the above case 2 of the resin material can be reduced in its weight as compared with the conventional metallic case, lighter weight may be achieved in the finished product.

Another advantage available with the present embodiment is that, since the respective central conductors 3, input and output electrode films 20, and grounding electrode films 16, etc. are formed by electroless plating, pattern formation may be readily effected. Especially, in the above case, not only is favorable electrical conductivity available, but also heat conduction may be lowered as compared with conventional metallic terminals. Therefore, during reflow soldering of the respective part elements referred to earlier, heat due to soldering is not readily transmitted to the respective part elements, and thus, adverse effects on the electrical characteristics can be avoided, and reliability with respect to the quality may be improved.

Moreover, since the capacitor electrode films 17*a* to 17*c* are formed by the electroless plating process, dimensional accuracy may be improved to provide more accurate capacitance value to that extent. By this arrangement, the problem in the conventional capacitor electrode films that, since such films are formed by thick film printing on a dielectric substrate for subsequent baking, they tend to slip off, may be solved.

In the present embodiment, the respective part elements such as the substrate portion 2*e*, terminal portions 8, etc. are integrally formed with the case 2, and therefore, soldered connections may be reduced to a large extent as compared with the conventional arrangements, for quality improvement from this point of view also.

It should be noted here that, in the foregoing embodiment, although the central conductors 3, capacitor electrode films 17*a* to 17*c*, and grounding electrodes 16, etc. for constituting the circuit element main body are all formed to cover the substrate portion 2*e*, the arrangement may, for example, be so modified to form at least part of the circuit element main body on the substrate portion and the remaining portion on the side walls, or to form all of the circuit elements on the side walls of said case 2.

Similarly, in the above embodiment, the present invention has been described with respect to one example in which the case is formed by injection molding in two stages through employment of the resin material to which the plating can adhere and the resin to which the plating can not adhere, and subsequent application of electroless plating thereto, but the method of forming the electrode films is not limited to the above, but for example, the photo-etching process or the like may be employed for the purpose.

It should be noted here that in the foregoing embodiment, although the description has been given with respect to the case where two ferrite members and two permanent magnets are respectively employed, the arrangement may be modified to employ only one ferrite member and one permanent magnet if the required characteristics are not very high.

It should further be noted that, in the foregoing embodiment, although the description has been made with reference to the lumped-parameter type isolator taken up as one example, the present invention is not limited in its application, to the isolator of this type alone, but may of course be readily applied to an isolator of the distributed constant type also. It may also be applied to a circulator, by removing the resistor connected to the capacitor electrode film, and coupling the terminal portion to said capacitor electrode film.

As is seen from the foregoing description, in the non-reciprocal circuit element according to the first embodiment of the present invention, since the case is made of an electrically insulative resin, while the electrode film means constituting at least part of the circuit element main body is formed in said case, the time-consuming assembling work conventionally required may be eliminated, with simultaneous reduction of the number of parts. As a result, the productivity can be improved for cost reduction, while the compact size and weight reduction may also be achieved.

Referring further to FIGS. 7 to 14, there is shown a non-reciprocal circuit element E2 according to a second embodiment of the present invention as applied to a lumped-parameter type circulator.

Figure 13:
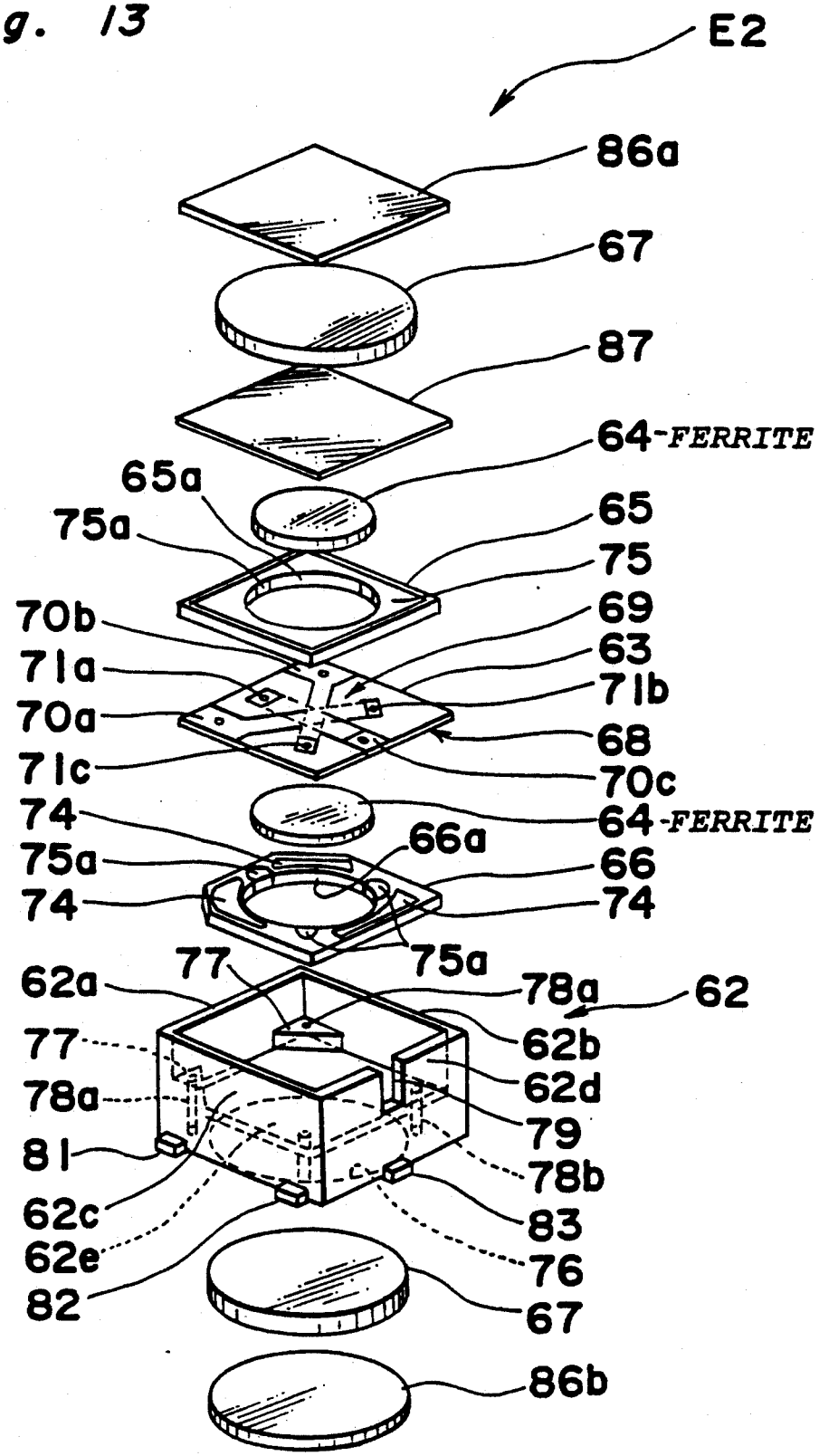
FIG. 13 is an exploded perspective view showing construction of the circulator according to the second embodiment of the present invention.

As shown in FIG. 13, the lumped-parameter type circulator E2 includes a box-like case 62, a central conductor substrate 63 disposed in said case 62, a pair of ferrite members 64 disposed to contact opposite main surfaces of said central conductor substrate 63, a set of first and second dielectric substrates 65 and 66 disposed to surround the respective ferrite members 64, and a pair of permanent magnets 67 disposed to confront said central conductor substrate 63, with said dielectric substrates 65 and 66 held therebetween, thereby to apply a d.c. magnetic field to said central conductor substrate 63 by said permanent magnets 67.

Moreover, on the upper face of said case 62, a rectangular plate-like magnetic metallic yoke 86*a* is disposed, while, on the lower face of said case 62, a circular disc-like magnetic metallic yoke 86*b* is provided, and these yokes 86*a* and 86*b* are intended to close the openings of said case 62 so as to form a magnetic closed circuit. Additionally, a shield plate 87 is further disposed between the upper permanent magnet 67 and the first dielectric substrate 65.

Figure 14:
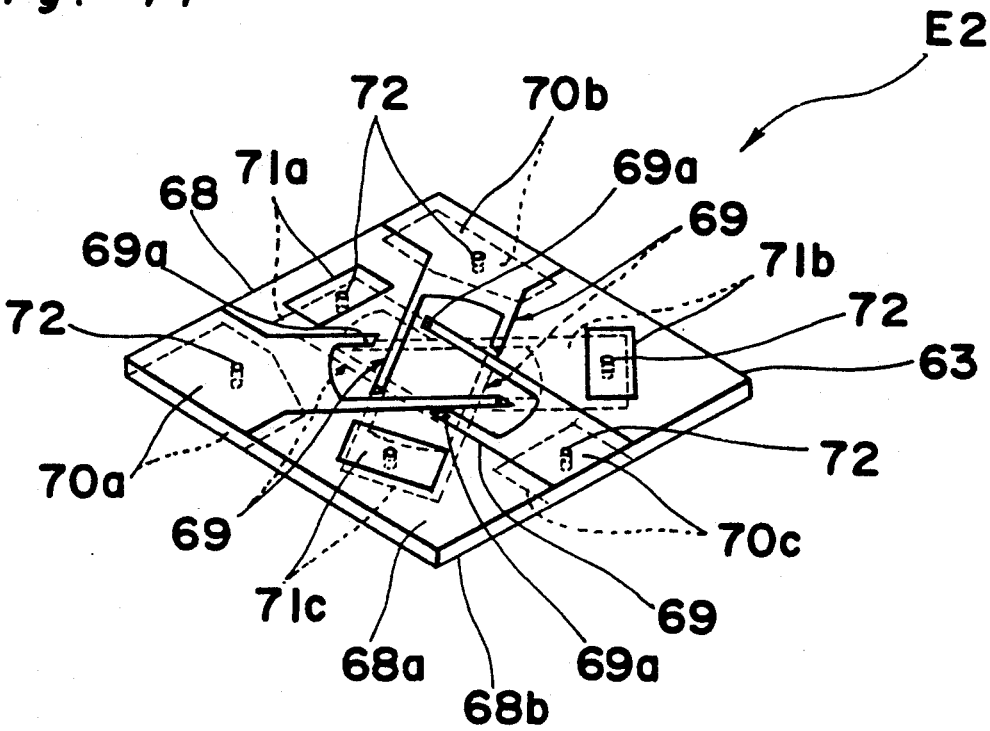
FIG. 14 is a perspective view of a central conductor substrate employed in the arrangement of FIG. 13.
Figure 15:
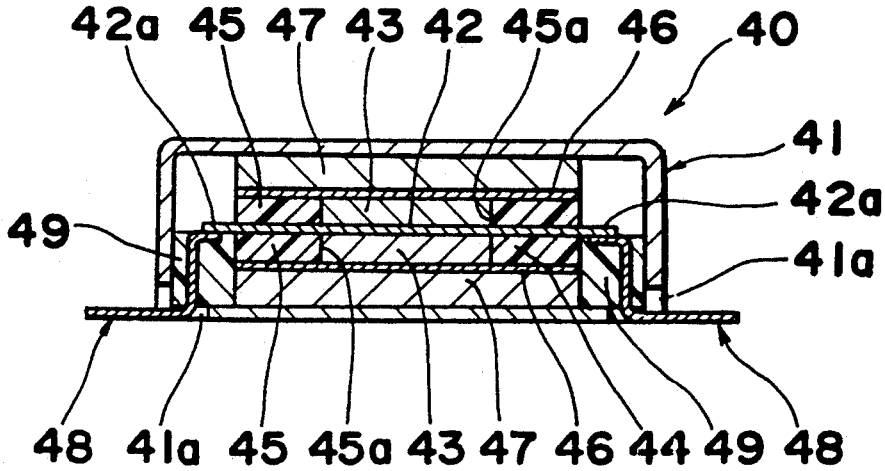
Fig. 15 PRIOR ART
FIG. 15 is a side sectional view showing construction of a conventional isolator (already referred to).

As shown in FIG. 14, the central conductor substrate 63 further includes an insulative substrate 68 made of a high dielectric constant material, upper parts of three sets of central conductors 69 (shown by solid lines) formed on one main surface 68*a* of said substrate 68, and remaining lower portions of said central conductors (shown by dotted lines) formed on the other main surface 68*b* thereof. The confronting portions of the central conductors 69 on the respective main surfaces 68*a* and 68*b* are connected by through-hole electrodes 69*a*, whereby the respective central conductors 69 are in an electrically insulated state and intersect or cross each other at an interval of 120°, with said ferrite members 64 contacting said intersecting portions.

At the lead-out end portions of the respective central conductors 69, and on both of the opposite main surfaces 68*a* and 68*b*, lead-out electrode films 70*a*,70*b* and 70*c* respectively facing each other through said substrate 68 are formed, and connected to the lead-out end portions of said central conductors 69. Moreover, at the forward end portions of the respective central conductors 69, and on both of the opposite main surfaces 68*a* and 68*b*, grounding electrode films 71*a*,71*b* and 71*c* confronting each other through said substrate 68 are formed, with said electrode films 71*a* to 71*c* being connected to the forward ends of the central conductors 69. The respective lead-out electrode films 70*a*,70*b* and 70*c*, and the respective grounding electrode films 71*a*,71*b* and 71*c* are each conducted by through-hole electrodes 72 as shown.

On the other hand, at the central portions of said first and second dielectric substrates 65 and 66, insertion holes 65*a* and 66*a* are formed, and the ferrite members 64 referred to earlier are respectively disposed in said insertion holes 65*a* and 66*a*. On the confronting respective faces of each of said dielectric substrates 65 and 66 that confront each other, three matching circuit capacitor electrode films 74 are formed, and the respective electrode films 74 are connected to the lead-out electrode films 70*a* to 70*c* of said central conductors 69. Moreover, approximately over the entire surface of each of said dielectric substrates 65 and 66 not facing each other, grounding electrode films 75 are formed, and some portions e.g. three portions 75*a* of said grounding electrode films 75 are extended onto the confronting face sides of the substrates 65 and 66 along edge portions of the insertion holes 65*a* and 66*a*, and such extended portions 75*a* are connected to the grounding electrode films 71*a*,71*b* and 71*c* of said central conductors 69.

The case 62 is molded from an electrically insulative resin and is of a rectangular cubic box-like configuration formed by one-piece molding of first, second, third and fourth side walls 62*a*, 62*b*,62*c* and 62*d*, and a bottom wall 62*e* formed with a circular opening 76, in which the permanent magnet 67 and the metallic yoke 86*b* shown thereunder in FIG. 13 are accommodated. Moreover, at corner portions on the upper surface of the bottom wall 62*e* where the first side wall 62*a* is adjacent to the second and third side walls 62*b* and 62*c*, stepped portions 77 of a triangular shape are formed to protrude. With outer edges of these stepped portions 77, corresponding chamfered edge portions of the second dielectric substrate 66 are engaged, and the upper faces of said stepped portions 77 are generally flush with the upper surface of said substrate 66.

Furthermore, at the corner portions formed by the respective side walls 62*a* to 62*d* within the case 62, through-holes 78*a* and 78*b* extending through the bottom wall 62*e* to its lower surface are formed, with the upper ends of the through-hole 78*a* being respectively positioned at the upper faces of the stepped portions 77 and the upper ends of the through-holes 78 being at the upper face of the bottom wall 62*e*, . Additionally, at a central portion of the fourth side wall 62*d*, is a slit portion 79 extending downwards from the upper edge of said side wall 62*d* and located at generally the same plane in the depth.

Moreover, at the lower opposite ends on the outer face of each of the second and third side walls 62*b* and 62*c* of said case 62, a terminal portion 81 and a grounding portion 82 are integrally molded, while at the lower central portion on the outer face of said fourth side wall 62*d*, another terminal portion 83 is also integrally formed.

Figure 8:
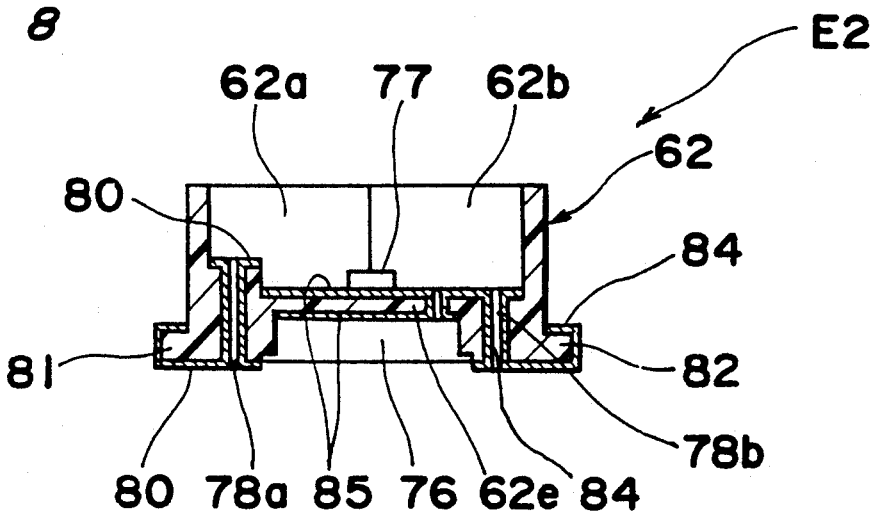
FIG. 8 is a cross section taken along the line VIII—VIII in FIG. 10.
Figure 9:
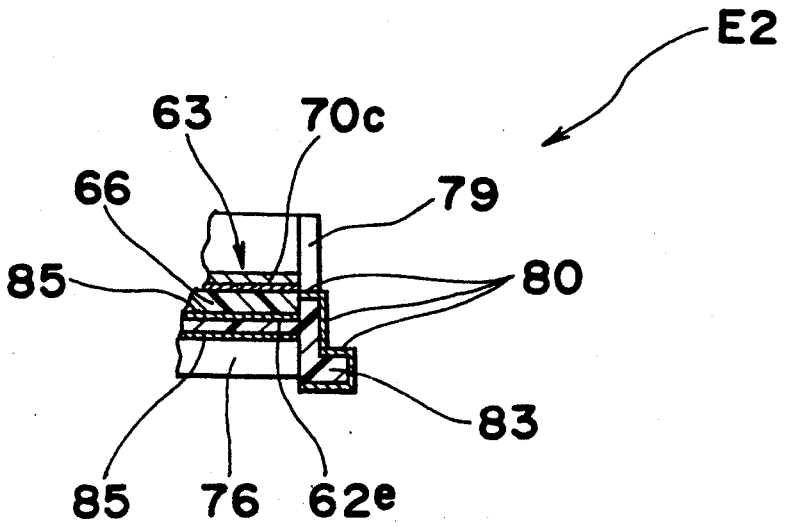
FIG. 9 is a fragmentary cross section taken along the line IX—IX in FIG. 10.
Figure 10:
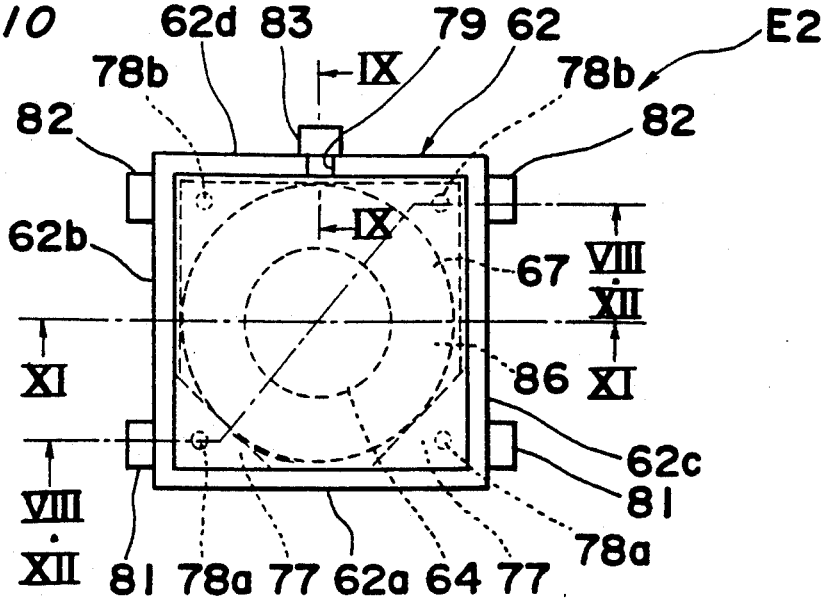
FIG. 10 is a top plan view of a circulator as assembled shown in FIG. 13.
Figure 11:
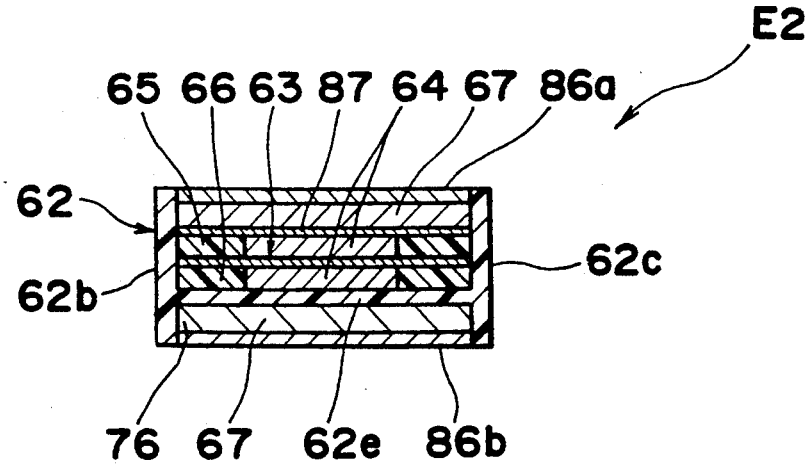
FIG. 11 is a cross section taken along the line XI—XI in FIG. 10.
Figure 12:
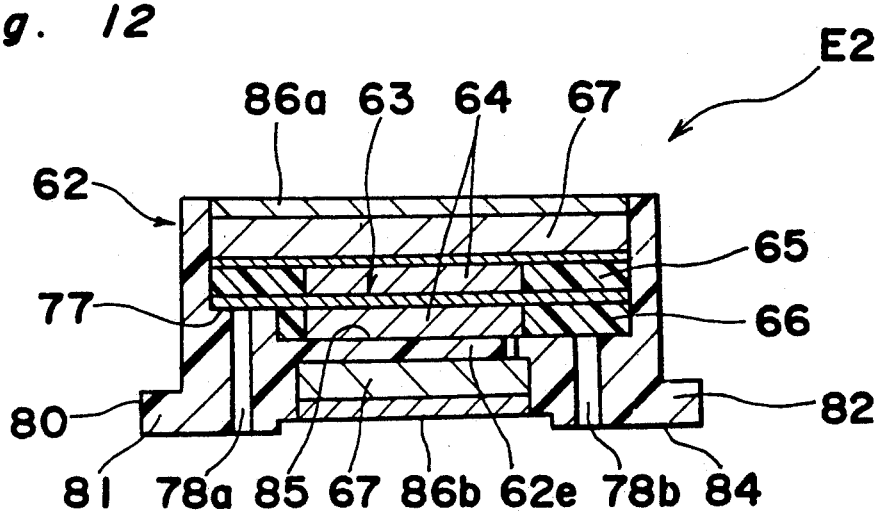
FIG. 12 is also a cross section taken along the line XII—XII in FIG. 10.

As shown in FIGS. 8 and 9, extending from the outer face of each of the terminal portions 81 through the peripheral face of the through-hole 78*a*, towards the upper face of the stepped portion 77, an input and output electrode film 80 is formed. Such input and output electrode film 80 is also formed to extend over the outer face of the terminal portion 83, the outer face of the fourth side wall 62*d* extending onto the slit portion 79, and the bottom face of the slit portion 79 (FIG. 9). Moreover, a grounding electrode film 84 is formed over the outer faces of the grounding portions 82 and the inner peripheral face of each through-hole 78*b*, and is connected to shield electrode films 85 formed over the entire upper and lower surfaces of the bottom wall 62*e* of the case 62, and thus, said bottom wall 62*e* constitutes a shield portion.

It should be noted here that the input and output electrode films 80, grounding electrode film 84, and shield electrode films 85 are formed by selectively applying electroless plating.

For such selective plating, for example, a similar practice as also referred to earlier in the first embodiment may be adopted.

Specifically, the portions of the case 62 corresponding to the respective terminal portions 81 and 83, grounding portions 82, bottom wall 62*e*, and through-holes 78*a* and 78*b* are first molded by injection molding employing a resin material to which the plating can adhere. Subsequently, the resultant molded item is placed in a metal mold corresponding to the entire configuration of the case 62, and another resin material to which the plating can not adhere is poured into said metal mold. By such injection molding in two stages, the case 62 is formed. Thereafter, by applying the electroless plating to said case 62, the respective electrode films 80,84 and 85 are formed at the required portions for the respective terminal portions 81 and 82, grounding portion 82, bottom wall 2*e*, and through-hole 78*a* and 78*b*.

Thus, the lead-out electrode films 70*a* to 70*c* of the respective central conductors 69 are connected to the capacitor electrode films 74, and also to the input and output electrode film 80 by soldering so as to be led out to the respective terminal portions 81 and 83. Meanwhile, the grounding electrode films 71*a* to 71*c* of the respective central conductors 69 are connected to the grounding electrode film 84 through the extended portion 75*a* of the grounding electrode 75 so as to be led out to the respective grounding portions 82.

It is to be noted here that, depending on necessity, matching circuit means may further be provided between the respective terminal portions 81 and 83, and the lead-out electrode films 70*a* to 70*c* of the central conductors 69. In the present invention, such a case is also referred to as "being led out".

The circulator E2 of the second embodiment as described so far also has a function to prevent back-flow of a signal, and is essential to a mobile communication equipment such as a portable telephone, automobile telephone or the like.

According to the second embodiment of the present invention, the case 62 is made of the insulative resin, while the terminal portions 81 and 83 and the grounding portion 82 are integrally formed on the outer surface of said case 62 for external leading out by the respective electrode films 80 and 84 formed thereon, the and therefore, conventional terminal block may be dispensed with, for reduction of size by that extent. Moreover, the case 62 made of the insulative resin may be made light in weight as compared with the conventional metallic case, thus contributing to the weight reduction also.

According to the foregoing embodiments, since the respective input and output electrode film 80, ground electrode film 84, and shield electrode film 85 are formed by the electroless plating, not only can favorable electrical conductivity be obtained, but also heat conduction may be lowered as compared with that of the conventional metallic terminals. Owing to the fact that, during reflow soldering of the respective parts, soldering heat is not readily conducted to the respective parts, adverse effects on their characteristics may be avoided for improvement of reliability with respect to quality.

The foregoing second embodiment has been also described with respect to one example in which the case is formed by injection molding in two stages through employment of the resin material to which the plating can adhere and the resin material to which the plating can not adhere and subsequently applying electroless plating thereto. However, the method of forming the electrode films is not limited to the above, but for example, the photo-etching process or the like may be employed for the purpose.

It should be noted here that, in the second embodiment, although the description has been given with respect to the case where two ferrite members and two permanent magnets are respectively employed, the construction may be so modified to use only one ferrite member and one permanent magnet if the required characteristics are not very high.

It is to be further noted that although in the second embodiment, the magnetic metallic yokes are disposed only on the upper and lower faces of said case 62, the structure may, for example, be so modified to accommodate the case 62 in a magnetic metallic case, thereby to constitute a magnetic shield means.

It should further be noted that, in the foregoing embodiment, although the description has been made with reference to the lumped-parameter type circulator taken up as one example, the present invention is not limited, in its application, to the circulator of this type alone, but also may of course be readily applied to a circulator of the distribution constant type. It may also be applied to an isolator by connecting one end of a resistor to one capacitor electrode film and the other end thereof to ground, thereby to constitute the input and output end portions As is clear from the foregoing description, by the non-reciprocal circuit element according to the present invention, since the case is made of the insulative resin, while the electrode films for externally leading out the central conductors are formed in said casing, not only is the part made compact in size and light in weight, but cost reduction may be achieved through reduction of the number of parts and man-hours required for the assembling.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a non-reciprocal circuit element comprising: a case; a circuit element main body including a plurality of intersecting central conductors in said case which are electrically insulated from each other and including matching circuitry; and means including ferrite members disposed in said case to confront said central conductors for impressing a DC magnetic field thereon; the improvement comprising:

the case being comprised of insulating resin; and at least part of said circuit element main body being comprised of an electrode material film formed on said insulating resin case.

2. The improvement of claim 1, wherein said central conductors are comprised of an electrode material film forming on said insulating resin case.

3. The improvement of claim 2, wherein said central conductors are formed on an insulating resin substrate which is integrally formed with said case.

4. The improvement of claim 3, wherein said substrate has first and second main surfaces; a first portion of each of said central conductors is formed on said first main surface; a second portion of each of said central conductors is formed on said second main surface; and the first and second portions of each of said central conductors are connected to each other by a through-hole electrode extending through said substrate.

5. The improvement of claim 2, further comprising respective input/output electrodes for connecting said central conductors with external circuitry, said input-/output electrodes being comprised of an electrode material film formed on said insulating resin case.

6. The improvement of claim 1, wherein said matching circuitry is comprised of an electrode material film formed on said insulating resin case.

7. The improvement of claim 6, wherein said matching circuitry is formed on an insulating resin substrate which is integrally formed with said case.

8. The improvement of claim 6, further comprising respective input/output electrodes for connecting said central conductors with external circuitry, said input-/output electrodes being comprised of an electrode material film formed on said insulating resin case.

9. In a non-reciprocal circuit element comprising: a case; a plurality of intersecting central conductors in said case which are electrically insulated from each other; and means including ferrite members disposed in said case to confront said central conductors for impressing a DC magnetic field thereon; the improvement comprising:

respective input/output electrodes for connecting said central conductors with external circuitry;

the case being comprised of insulating resin; and said input/output electrodes being comprised of an electrode material film formed on said insulating resin case.

10. The improvement of claim 9, wherein said central conductors are comprised of an electrode material film formed on said insulating resin case.

11. The improvement of claim 10, wherein said central conductors are formed on an insulating resin substrate which is integrally formed with said case.

12. The improvement of claim 11, wherein said substrate has first and second main surfaces; a first portion of each of said central conductors is formed on said first main surface; a second portion of each of said central conductors is formed on said second main surface; and the first and second portions of each of said central conductors are connected to each other by a through-hole electrode extending through said substrate.

* * * * *